US008757281B1

(12) United States Patent
Saba

(10) Patent No.: US 8,757,281 B1
(45) Date of Patent: Jun. 24, 2014

(54) FIRE PREVENTION COMBINATION ASSEMBLY

(76) Inventor: Ronald W. Saba, Wilkes Barre, PA (US)

( * ) Notice: Subject to any disclaimer, the term of this patent is extended or adjusted under 35 U.S.C. 154(b) by 379 days.

(21) Appl. No.: 13/239,542

(22) Filed: Sep. 22, 2011

(51) Int. Cl.
*A62C 37/10* (2006.01)

(52) U.S. Cl.
USPC ..... 169/61; 169/65

(58) Field of Classification Search
CPC ..... A62C 3/006; A62C 2/00
USPC ..... 169/65, 61, 54, 23
See application file for complete search history.

(56) References Cited

U.S. PATENT DOCUMENTS

| | | | | |
|---|---|---|---|---|
| 4,098,284 | A | 7/1978 | Yamada | |
| D281,808 | S | 12/1985 | Lemkin et al. | |
| 4,782,420 | A | 11/1988 | Holdgaard-Jensen | |
| 5,945,017 | A | 8/1999 | Cheng et al. | |
| 6,294,994 | B1 | 9/2001 | Hoellerich | |
| 6,648,077 | B2 * | 11/2003 | Hoffman | 169/56 |
| 6,684,757 | B2 | 2/2004 | Petersen | |
| 7,109,879 | B2 | 9/2006 | Stults et al. | |
| 7,327,246 | B2 | 2/2008 | Schoor | |
| D577,301 | S | 9/2008 | Johnson et al. | |
| 2009/0017404 | A1 | 1/2009 | White et al. | |
| 2009/0294141 | A1 * | 12/2009 | Rouse et al. | 169/65 |

* cited by examiner

*Primary Examiner* — Davis Hwu

(57) ABSTRACT

A fire prevention combination assembly for shutting off an energy source to a stove when smoke is detected includes a smoke detector that is configured for detecting smoke. An interface is provided which is configured to be connected to and between an energy inlet for a stove and an energy source. The interface is in communication with the smoke detector. The interface prevents communication between the stove and the energy source when the smoke detector detects smoke.

3 Claims, 4 Drawing Sheets

FIRE PREVENTION COMBINATION ASSEMBLY

BACKGROUND OF THE DISCLOSURE

Field of the Disclosure

The disclosure relates to fire prevention devices and more particularly pertains to a new fire prevention device for shutting off an energy source to a stove when smoke is detected.

SUMMARY OF THE DISCLOSURE

An embodiment of the disclosure meets the needs presented above by generally comprising a smoke detector that is configured for detecting smoke. An interface is provided which is configured to be connected to and between an energy inlet for a stove and an energy source. The interface is in communication with the smoke detector. The interface prevents communication between the stove and the energy source when the smoke detector detects smoke.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
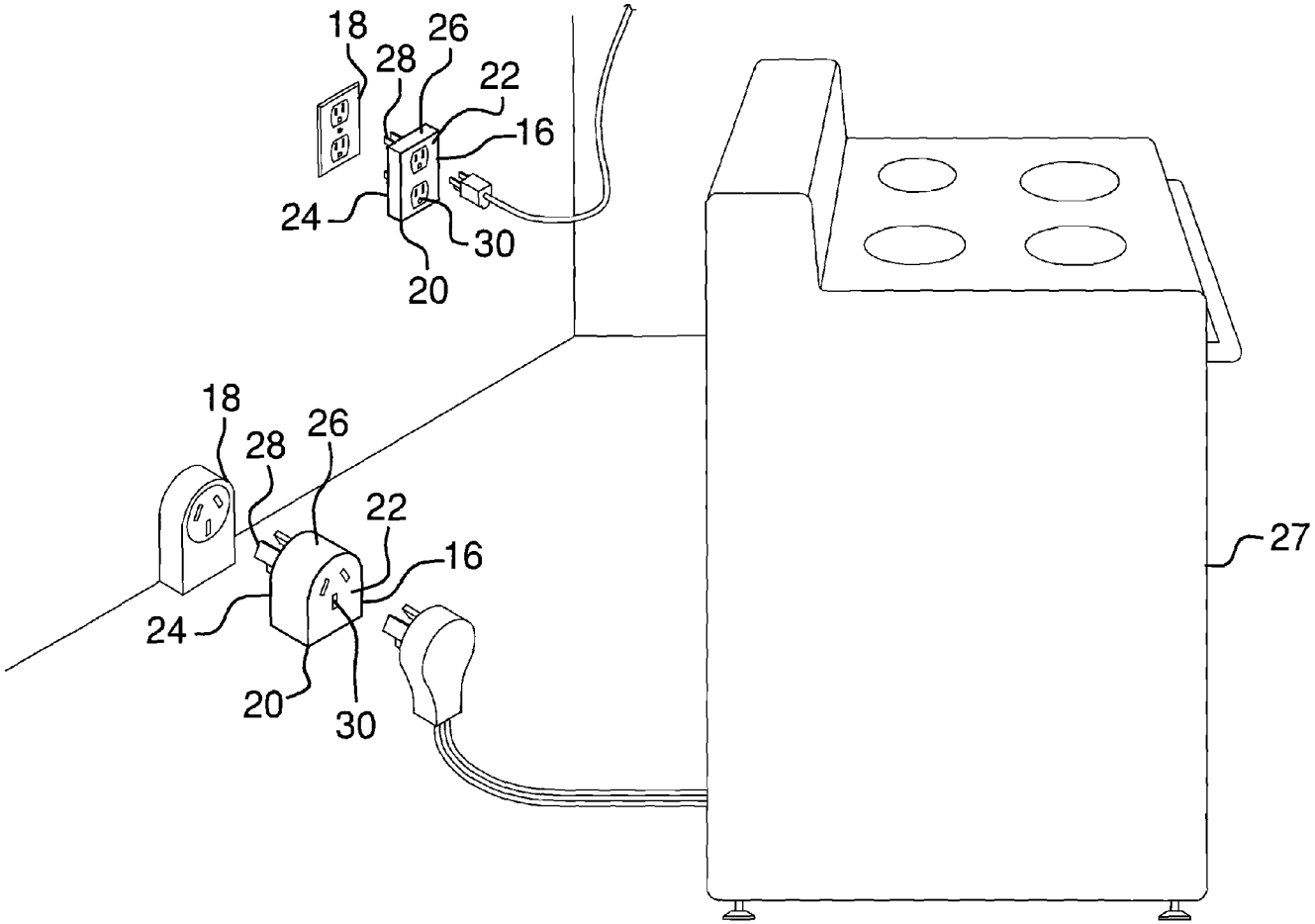
FIG. 1 is a side perspective view of a fire prevention combination assembly according to an embodiment of the disclosure.
Figure 2:
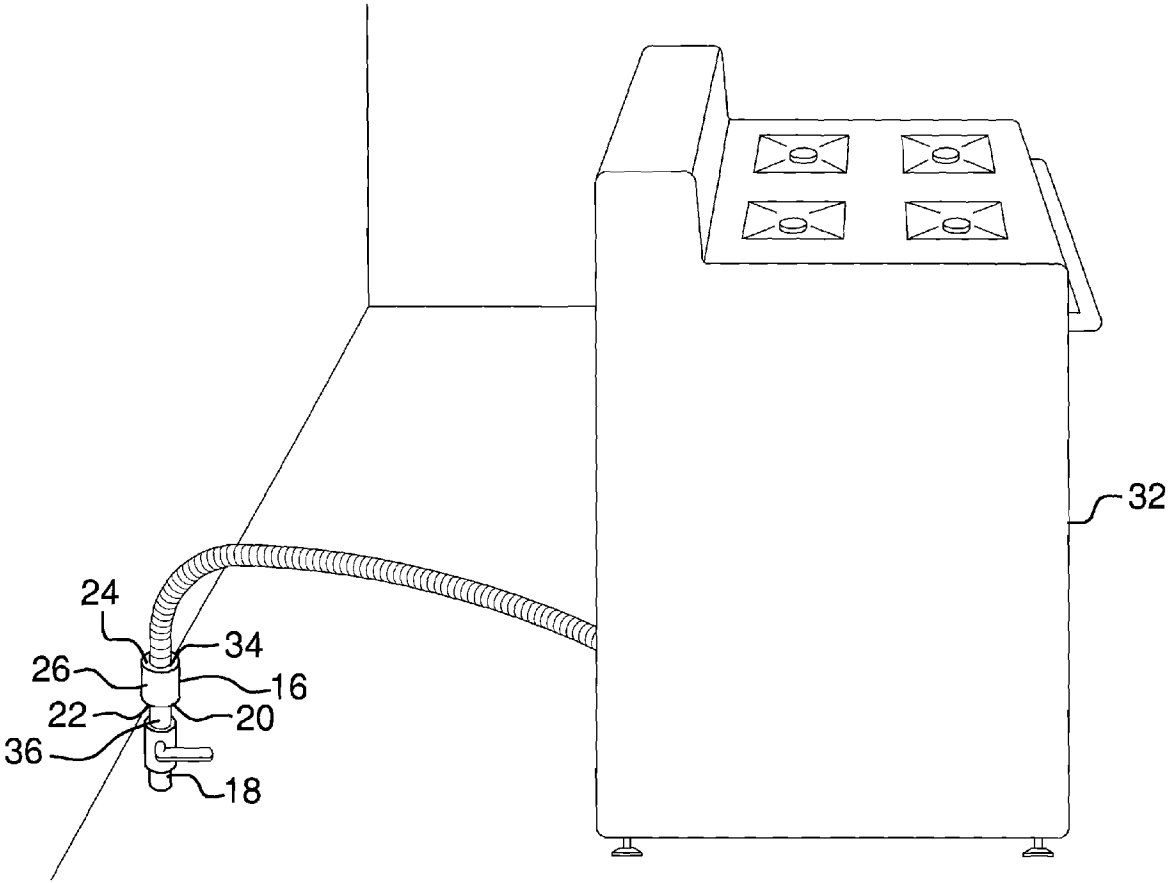
FIG. 2 is a side perspective view of an embodiment of the disclosure.
Figure 3:
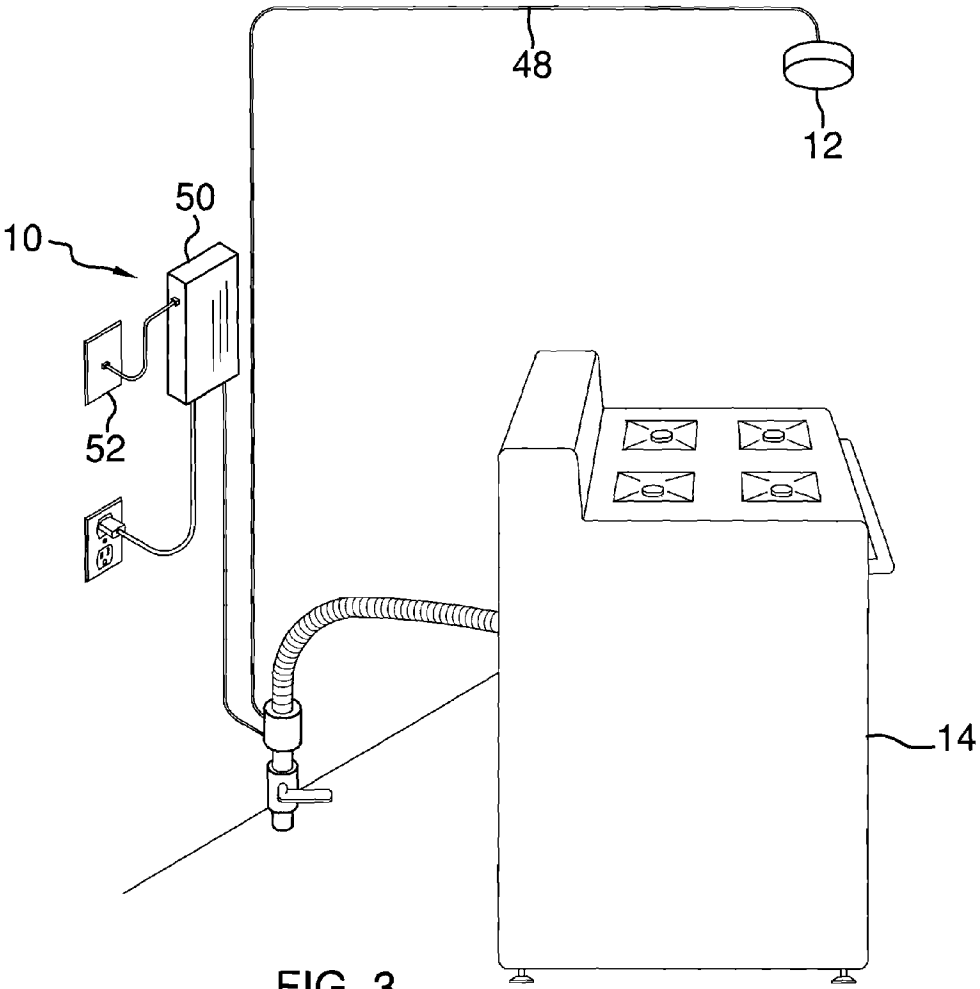
FIG. 3 is a side perspective view of an embodiment of the disclosure.
Figure 4:
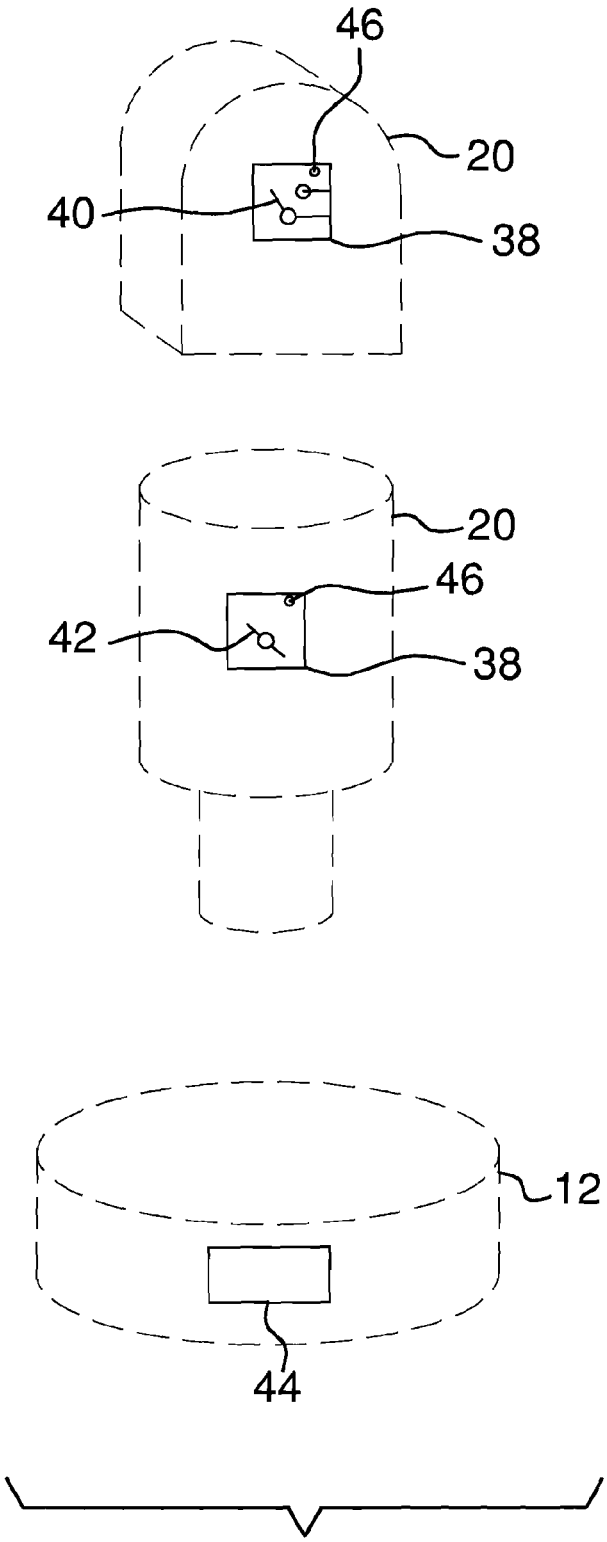
FIG. 4 is a side perspective phantom view of an embodiment of the disclosure.

With reference now to the drawings, and in particular to FIGS. 1 through 4 thereof, a new fire prevention devices embodying the principles and concepts of an embodiment of the disclosure and generally designated by the reference numeral 10 will be described.

As best illustrated in FIGS. 1 through 4, the fire prevention combination assembly 10 generally comprises a smoke detector 12 that is configured for detecting smoke. The smoke detector 12 may be mounted directly above a stove 14 and in particular positioned such that smoke from the stove will be quickly detected by the smoke detector 12.

An interface 16 is provided that is configured to be connected to and between an energy inlet for the stove 14 and an energy source 18. The interface 16 is in communication with the smoke detector 12. The interface 16 prevents communication between the stove 14 and the energy source 18 when the smoke detector 12 detects smoke. The 16 interface is comprised of a housing 20 with a front side 22, a back side 24 and a perimeter edge 26 that extends between the front 22 and back sides 24. For an electrical stove 27 or other electrical cooking appliance, a male plug 28 is mounted on the back side 24 and a female plug 30 extends into the front side 22. The male 28 and female plugs 30 are in electrical communication with each other. For a gas stove 32 a female gas connection 34 extends into the back side 24 and a male gas connection 36 is mounted on the front side 22. The male 36 and female gas connections 34 are in fluid communication with each other.

A control circuit 38 is mounted within the housing 20. For the electric stove 27 or other electric cooking appliance the control circuit 38 includes a shutoff switch 40 and is electrically coupled to the male 28 and female 30 plugs. In the electric stove 27 an electrical connection between the male 28 and female plugs 30 is stopped when the shutoff switch 40 is actuated. For the gas stove 32 the control circuit 38 includes a shutoff valve 42 and is mechanically coupled to the male 36 and female gas connections 34. The shut off valve 42 may be a solenoid actuated valve. With the gas stove 32 the fluid communication between the male 36 and female gas connections 34 is stopped when the shutoff valve 42 is activated. The control circuit 38 is in communication with the smoke detector 12 through either wireless communication or through wired communication. For wireless communication the smoke detector 12 will have a wireless transmitter 44 mounted inside and the control circuit 38 will include a wireless receiver 46. For wired communication the smoke detector 12 will have an electrical connection 48 to the control circuit 38. The shutoff switch 40 or shut off valve 42 is actuated when the smoke detector 12 communicates it has detected smoke.

An alerting member 50 is in communication with the control circuit 38 through an electrical connection. The alerting member 50 is also in communication with a telephonic communication system 52. The alerting member 50 is configured to notify emergency response personnel, such as for example sending an electronic or telephonic message to a 911 emergency response system, when the smoke detector 12 detects smoke.

In use, the smoke detector 12 will be mounted above a stove 14. The interface 16 will be installed on and between an energy source for the stove 14. In the absence of wireless communication between the interface 16 and the smoke detector 12, an electrical connection 48 will be installed between the interface 16 and the smoke detector 12. The alerting member 50 will be electrically connected to the interface 16. The alerting member 50 will also be connected to a telephone communication system 52. If the smoke detector 12 detects smoke, the interface 16 will receive a command to shut off the energy source to the stove 14 to prevent a fire and the alerting member 50 will contact the local fire department.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A fire prevention combination assembly configured for shutting off an energy source to a stove when smoke is detected, said combination assembly comprising:

a smoke detector being configured for detecting smoke; and an interface configured to be connected to and between an energy inlet for a stove and an energy source, said interface being in communication with said smoke detector, said interface preventing communication between the stove and the energy source when said smoke detector detects smoke, wherein said interface comprises a housing having a front side, a back side and a perimeter edge extending between said front and back sides, a male plug being mounted on said back side and a female plug extending into said front side, said male and female plugs being in electrical communication with each other, and a control circuit being mounted within said housing, said control circuit including a shutoff switch being electrically coupled to said male and female plugs, an electrical connection between said male and female plugs being stopped when said shutoff switch is actuated, said control circuit being in communication with said smoke detector, said shutoff switch being actuated when said smoke detector detects smoke.

2. The combination assembly according to claim 1, further including an alerting member in communication with said control circuit, said alerting member being in communication with a telephonic communication system, said alerting member being configured to notify emergency response personnel when said smoke detector detects smoke.

3. A fire prevention combination assembly configured for shutting off an energy source to a stove when smoke is detected, said combination assembly comprising:

a smoke detector being configured for detecting smoke;

an interface configured to be connected to and between an energy inlet for a stove and an energy source, said interface being in communication with said smoke detector, said interface preventing communication between the stove and the energy source when said smoke detector detects smoke, said interface comprising;

a housing having a front side, a back side and a perimeter edge extending between said front and back sides;

a male plug being mounted on said back side and a female plug extending into said front side, said male and female plugs being in electrical communication with each other;

a control circuit being mounted within said housing, said control circuit including a shutoff switch being electrically coupled to said male and female plugs, an electrical connection between said male and female plugs being stopped when said shutoff switch is actuated, said control circuit being in communication with said smoke detector, said shutoff switch being actuated when said smoke detector detects smoke; and an alerting member in communication with said control circuit, said alerting member being in communication with a telephonic communication system, said alerting member being configured to notify emergency response personnel when said smoke detector detects smoke.

* * * * *